US006752687B2

(12) United States Patent
Benning et al.

(10) Patent No.: US 6,752,687 B2
(45) Date of Patent: Jun. 22, 2004

(54) METHOD OF POLISHING DISKS

(75) Inventors: Frederick P. Benning, Rochester, MN (US); Steven L. Maynard, Rochester, MN (US); David C. Paurus, Byron, MN (US); Jon Edward Podolske, Wabasha, MN (US)

(73) Assignee: International Business Machines Corporation, Armonk, NY (US)

( * ) Notice: Subject to any disclaimer, the term of this patent is extended or adjusted under 35 U.S.C. 154(b) by 269 days.

(21) Appl. No.: 09/843,832

(22) Filed: Apr. 30, 2001

(65) Prior Publication Data

US 2002/0160689 A1 Oct. 31, 2002

(51) Int. Cl.[7] ..... B24B 7/22
(52) U.S. Cl. ..... 451/5; 451/56; 451/269
(58) Field of Search ..... 451/5, 21, 7, 72, 451/56, 443, 444, 269

(56) References Cited

U.S. PATENT DOCUMENTS 6,077,155 A * 6/2000 Hayakawa et al. ..... 451/288
6,142,859 A * 11/2000 Ross et al. ..... 451/443

FOREIGN PATENT DOCUMENTS

| | | | | |
|---|---|---|---|---|
| JP | 359081054 | * | 5/1984 | ..... 451/131 |
| JP | 402065967 | * | 3/1990 | ..... 451/288 |
| JP | 405177537 | * | 7/1993 | ..... 451/290 |
| JP | 406226628 | * | 8/1994 | ..... 125/11.01 |

* cited by examiner

*Primary Examiner*—Robert A. Rose
(74) *Attorney, Agent, or Firm*—Rabin & Berdo, PC

(57) ABSTRACT

A method of preparing for a disk polishing operation includes providing a polishing machine having a first and a second superposed platen. A first polishing pad is on the first platen and a second polishing pad is on the second platen. A plurality of carriers are disposed between the first and second polishing pads. Each carrier is adapted to rotate relative to the polishing pads and is adapted to carry at least one glass disk. A pressure, temperature and rotational speed of the polishing machine used during a disk polishing operation are determined. A number of diamond disks are provided. A diamond disk is placed in respective ones of the carriers. The polishing machine is operated at or near the determined pressure, temperature and rotational speed while simultaneously dressing the respective surfaces of the polishing pads using the diamond disks.

23 Claims, 4 Drawing Sheets

METHOD OF POLISHING DISKS

BACKGROUND OF THE INVENTION

1. Field of the Invention

The invention relates to a method of polishing disks, such as glass disks used as data storage devices.

2. Background Information

Circular-shaped magnetic disks are typically used in hard disk drives of computers, for example, for use in data storage applications. Such magnetic disks may be formed from aluminum or from glass, for example, and will typically have a magnetic surface coating located thereon. A head of the disk drive interacts with the magnetic surface coating to read and write information to the disk. Such magnetic disks have achieved storage capacities of several gigabytes or more, using current technology.

Typically, the head of the disk drive that reads and writes information to the disk is arranged to float a small distance above a surface of the disk. By bringing the head closer to the surface of the disk, higher density recording becomes possible.

As mentioned, often the magnetic disks are formed from aluminum. However, aluminum is relatively soft, so when it is handled, it is possible to ding the disk and form an area where data cannot be retrieved.

Further, the aluminum is typically coated with a nickel plating to give the disk more stiffness and a harder surface. However, the nickel plating has a tendency to become magnetic, causing errors in reading and writing to the disk.

Additionally, aluminum disks are limited in how smooth their surfaces can be made. The smoother a magnetic disk can be made, the closer the head can be brought to the surface of the disk during the read/write operations.

To overcome the problems associated with aluminum disks, attention has been directed to the utilization of glass disks. For example, the disks may be amorphous glass disks formed from sodium lithium or aluminosilicate glass.

Typically, computer manufacturers purchase blank glass disks, for example from a glass manufacturer. Once received, the computer manufacturer may subject the blank glass disks to various processes to prepare the glass disks for use as data storage devices. For example, the computer manufacturer may polish the blank glass disks—to remove surface scratches from the disks, and to planarize the surfaces of the disks to remove any waviness. Planarizing the surfaces of the disks provides for a smoother surface finish, allowing a head of an associated disk drive to be brought closer to the surface of a respective disk. By bringing the head closer to the surface of the disk, higher density recording becomes possible.

A typical machine used for polishing the disks includes two superposed platens respectively disposed over and under one or more of the disks, so that opposing surfaces of the disks can be polished simultaneously. Moreover, the polishing machine may include carriers that position and retain the disks during the polishing operation. Such carriers may be adapted to rotate relative to the platens. For example, the polishing machine may also include an outer ring gear, disposed around an outer periphery of the platens, and an inner gear, that projects through a hole formed in a center of the platens. The carriers can then have a toothed outer periphery, which engages with the teeth or pins of the outer ring gear and the teeth or pins of the inner gear. Rotation of the inner gear and outer gear in opposite directions, for example, thus causes the carrier to rotate globally around the inner gear, and about an axis of the carrier.

In order to protect the surfaces of the disks from being damaged by the hard surfaces of the platens during the polishing process, and to help retain a polishing slurry in contact with the surfaces of the disks, the polishing machine typically has a so-called polishing pad on a surface of each platen. A respective polishing pad thus separates the surface of the platen from the surface of the disk during the polishing operation.

Typically, the manufacturer of the polishing machine will polish the surfaces of the platens using a lapping technique, prior to the polishing machine being shipped to the end user. It is conventionally believed that the lapping technique provides the platens with a relatively flat and planar surface suitable for most polishing operations.

To polish the disks, the polishing slurry is provided on a surface of the disks. The platens are brought together to exert a predetermined pressure upon the disks, and the carriers and disks are rotated, thus planarizing and polishing the surfaces of the disks.

It has been noted that during the polishing of glass disks, for example, that the polishing pads are subject to increased wear at their inner diameters. Thus, due to this uneven wear, the polishing pads must be replaced at a relatively increased rate. Since the polishing pads are typically adhered to the platens using an adhesive, the replacement of the polishing pads requires that the polishing machine be removed from service for an extended period of time, thus reducing thru-put and increasing the cost of operations.

Thus, there is a need for a way to polish disks, such as glass disks that prevents uneven wear of the polishing pads.

It has further been observed that during the polishing of glass disks, for example, that the teeth of the carriers tend to wear prematurely. In fact, the teeth can become so worn that they will shear off from the carrier, causing the polishing machine to become inoperative (i.e., a so-called mid-cycle crash). As will be appreciated, since the carriers are relatively expensive, a long life is desirable. Moreover, mid-cycle crashes require that the polishing machine be removed from service for an extended period of time, thus reducing thru-put and increasing the cost of operations.

Thus, there is a need for a way to polish disks, such as glass disks that prevents premature wear of the carriers.

It has also been observed that the polished glass disks, for example, have thickness variations from the inner diameter to the outer diameter. However, these thickness variations reduce the strength of the disks in their thinner regions, increasing the likelihood that the disks may break and fail. Moreover, the thicker regions of the disks will define how close a head of an associated disk drive can be brought to the surface of the disk. That is, when the head is over the thinner regions of the disk, the head will be further from the surface of the disk than it was when it was over the thicker regions of the disk. This may lead to errors when reading and writing to the disks and/or reduce the density of recording to the disk.

Thus, there is a need for a way to polish disks, such as glass disks, so that the polished disks have a minimum of thickness variations across their respective surfaces.

SUMMARY OF THE INVENTION

It is, therefore, a principle object of this invention to provide a method of polishing disks.

It is another object of the invention to provide a method of polishing disks that solves the above mentioned problems.

These and other objects of the present invention are accomplished by the method of polishing disks disclosed herein.

In an exemplary aspect of the invention, a glass disk polishing operation is performed using a conventional polishing machine. For example, the Peter Wolters AC320 polishing machine has proven to be suitable for the polishing of the glass disks. Of course, other polishing machines may be used without departing from the spirit and scope of the invention.

In a further exemplary aspect of the invention, the platens of the polishing machine may be lap-polished by the end user, while operating the polishing machine at the same or similar operational variables (temperature, pressure and/or speed) as when polishing the glass disks. For example, the platens can be lapped using a lapping disk and a silicon-carbide compound, while exerting a force of about 500 daN (i.e., a force close to the force used in the polishing operation) over a total surface area similar to the total surface area of the glass disks to be polished.

In another exemplary aspect of the invention, the polishing pads of the polishing machine are dressed to compensate for irregularities in the surface profiles of the platens. It is significantly easier to dress the polishing pads to have a desired profile than it is to lap the platens in the manner described above. For example, whereas it may take up to a week to lap the platens to have a desired profile, the polishing pads can be dressed in as little time as 15 to 30 minutes, for example.

In this exemplary aspect of the invention, the polishing pads are dressed while operating the polishing machine at the same or similar pressure, temperature and/or rotational speed as when the disks are polished. By dressing the polishing pads in this manner, the underlying profile of the platens can be effectively ignored, since the dressed polishing pads will compensate for any irregularities in the surface profile of the platens.

In another exemplary aspect of the invention, the polishing pads are dressed using specifically tailored dressing disks that are disposed within the holes or recesses of the carriers of the polishing machine. The dressing disks have a similar configuration to the glass disks, so that they fit within the respective holes or recesses of the carriers in a manner similar to the glass disks. That is, the dressing disks have a surface area similar to the disks. Further, and similar to the glass disks, the dressing disks are thicker than the carriers, so that the upper and lower surfaces of the respective dressing disks contact the exposed surfaces of the polishing pads. This approach allows the polishing machine to be operated at or near the same conditions used for polishing the glass disks.

In another exemplary aspect of the invention, the force applied by the polishing machine is controlled depending on the number of dressing disks used. By way of example, if using fifty dressing disks in an arrangement adapted to accommodate fifty glass disks, then a force of about 500 daN may be applied for the dressing operation. However, if only thirty dressing disks are used in an arrangement adapted to accommodate fifty glass disks, in order to maintain a similar pressure as when using fifty disks, the force may be reduced to about 300 daN. This ensures that the pressure exerted by the dressing disks is not so great as to destroy the polishing pads.

In a further aspect of the invention, the dressing disks have their outer surfaces imbedded with diamond particles. Due to the hardness of the diamond particles, the dressing disks are resistant to wear during the dressing procedure. The diamond particles thus ensure that the dressing disks retain their dressing ability for a relatively long period of time. Moreover, the diamond particles allow the dressing procedure to be performed without requiring any further dressing compounds, which may contaminate the polishing procedures. However, water may be used during the dressing procedure to reduce heat build-up and to rinse away particles of the polishing pads removed during the dressing procedure.

The dressing disks may further include a stainless steel substrate, which could be plated with a further material that serves as a carrier for the diamond particles. For example, the further material could be a nickel plating. This configuration of the dressing disks has been shown to be able to withstand the high forces and pressures applied during the dressing operation.

In order for the polishing pads to compensate for the surface irregularities in the surface profiles of the platens, the polishing pads advantageously will have a thickness greater than an amount of deviation being compensated for. For example, if the surfaces of the platens deviate from a parallel state by 0.005 inches, then it may be desired to have relatively thick polishing pads, such as ones having a thickness of about 0.05 inches.

In the aforementioned processes, the parameters used during the lapping or dressing operations may be within about 10 percent or closer, for example, 5 percent, of the parameters used during the polishing of the glass disks. Moreover, it is currently believed that the applied pressure exerts the greatest influence on the surface profile of the platens, followed by the temperature.

DETAILED DESCRIPTION OF THE PREFERRED EMBODIMENTS

The invention will now be described in more detail by way of example with reference to the embodiments shown in the accompanying figures. It should be kept in mind that the following described embodiments are only presented by way of example and should not be construed as limiting the inventive concept to any particular physical configuration.

Further, if used and unless otherwise stated, the terms "upper," "lower," "front," "back," "over," and similar such terms are not to be construed as limiting the invention to a particular orientation. Instead, these terms are used only on a relative basis.

Figure 1:
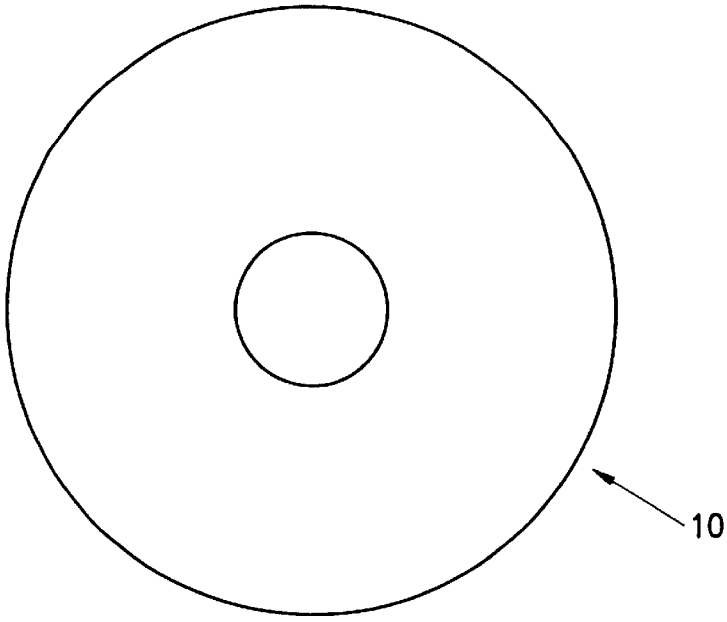
FIG. 1 is an elevational view of an exemplary glass disk used with the present invention.

Referring to FIG. 1, the present invention is directed toward a polishing arrangement and method for polishing disks 10, such as glass disks used as data storage devices in disk drives. By way of example, the glass disks 10 may be formed from sodium lithium glass. Further, the disks 10 may have a standardized diameter. For example, the disks 10 may have one of a diameter of 65, 70, 84, or 95 millimeters. Further, the disks 10 may have a concentric hole having a diameter, for example, of about 25 millimeters, for receiving a rotatable shaft of a disk drive (not shown), for rotating the disk. Of course, the invention is not limited to disks of these particular sizes or configurations. To the contrary, the disks may have other sizes or shapes within the spirit of the invention.

The glass disks 10 may be purchased as blanks by an end user, such as a computer manufacturer, from a glass manufacturer. After receipt, the computer manufacturer may subject the glass disks 10 to various treatments, in order to provide disks that are better suited for use in data storage applications. For example, it may be desired that the final product have a smoother surface finish, so that a head of an associated disk drive can be brought closer to the surface of the disk, thereby providing for higher density recording. Thus, the computer manufacturer may subject the glass disks to a first step polishing operation, followed by various subsequent treatments.

Figure 2:
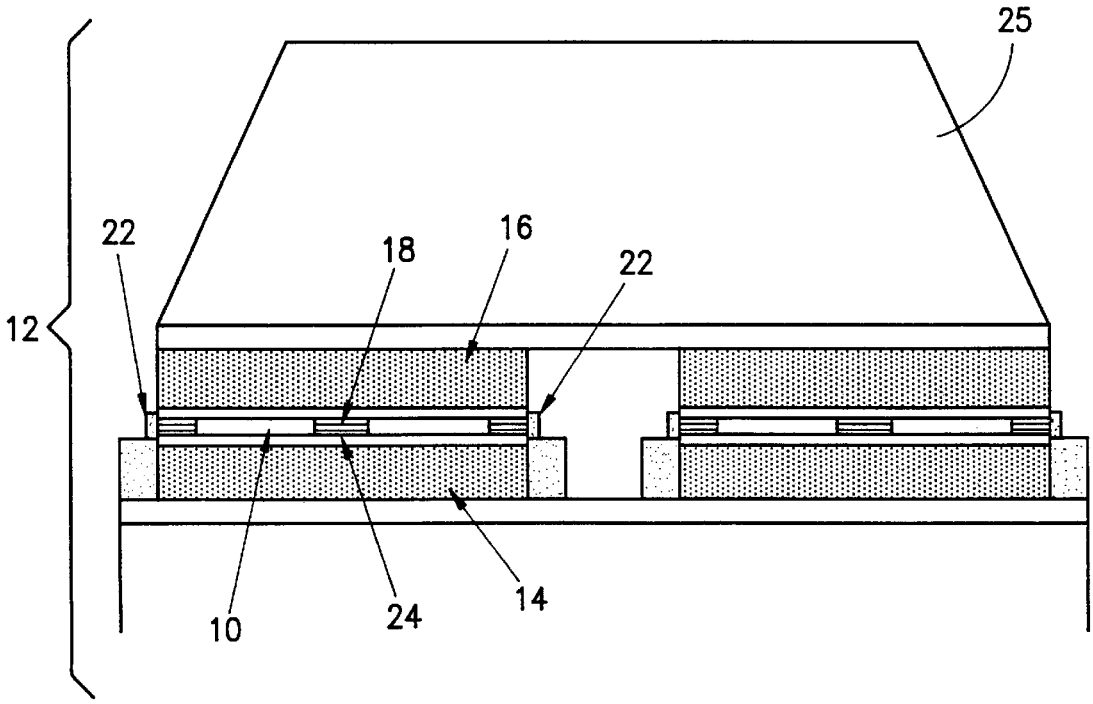
FIG. 2 is a cross-sectional view of an exemplary polishing machine used with the present invention.

Referring to FIG. 2, in an exemplary aspect of the invention, the first step polishing operation is performed using a conventional polishing machine 12. For example, the Peter Wolters AC320 polishing machine has proven to be suitable for the polishing of the glass disks 10. Of course, other polishing machines may be used without departing from the spirit and scope of the invention.

The exemplary polishing machine 12 includes a lower platen 14 and a superposed upper platen 16. The upper platen 16 and the lower platen 14 are disposed over and under, respectively, one or more disks 10, so that opposing surfaces of the disks can be polished simultaneously (i.e., the polishing machine 12 is a double-sided polishing machine). That is, the disks 10 are sandwiched between the platens 14, 16. However, it is also contemplated that the concepts of the present invention can be used with a single-sided polishing machine (not shown), i.e., a polishing machine that polishes only one side of a disk, for example, at a time.

Figure 3:
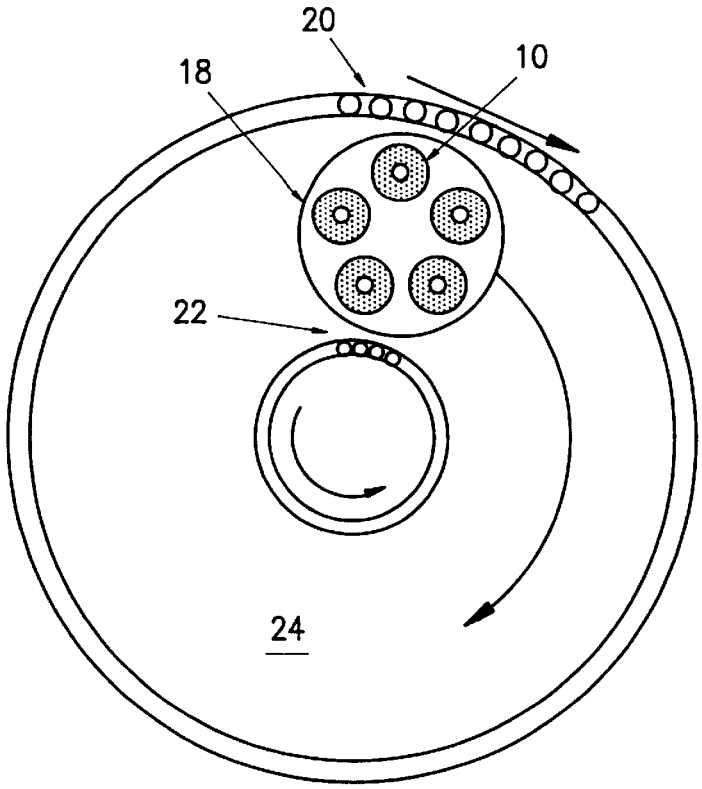
FIG. 3 is a top-down view of one exemplary aspect of the polishing machine shown in FIG. 2, with an upper platen being removed for illustration purposes.

Moreover, the exemplary polishing machine 12 includes one or more carriers 18, with the disks 10 being disposed in recesses or through holes formed in the carriers. For example, and referring also to FIG. 3, in an exemplary aspect of the invention, each carrier 18 has five through holes, so that each carrier can receive a number of glass disks. For example, the carrier 18 shown in FIG. 3 can accommodate up to five glass disks 10. Of course, this number can be varied without departing from the spirit and scope of the invention. For example, and referring briefly to FIG. 4, the carriers 18 shown in this illustration have four through holes, so that these carriers can accommodate up to four glass disks.

In the exemplary aspect of the invention, the diameters of the through holes or recesses are slightly greater than a diameter of the glass disks 10, so that the glass disks 10 are free to rotate within the respective through holes or recesses. Further, the carriers 18 are relatively thin, i.e., thinner than the disks 10 that are accommodated within the recesses or through holes, so that the surfaces of the disks project beyond the surfaces of the carrier so as to be available for polishing.

The carriers 18 are caused to rotate relative to the platens 14, 16 during the polishing of the disks 10. For example, the exemplary polishing machine 12 may include an outer ring gear 20, disposed around an outer periphery of the platens 14, 16, and an inner gear 22, that projects through a hole formed in a center of the platens. The carriers 18 can then have a toothed (not shown) outer periphery that engages with the teeth or pins of the outer ring gear 20 and the teeth or pins of the inner gear 22. Rotation of the inner gear 22 and outer gear 20 in opposite directions, for example, thus causes the carrier 18 or carriers to rotate globally around the inner gear, and about an axis of the respective carrier. An exemplary glass disk polishing speed would be to rotate the carrier 18 globally at about 1 rpm (revolutions per minute), and about its axis at about 35 rpm.

Figure 4:
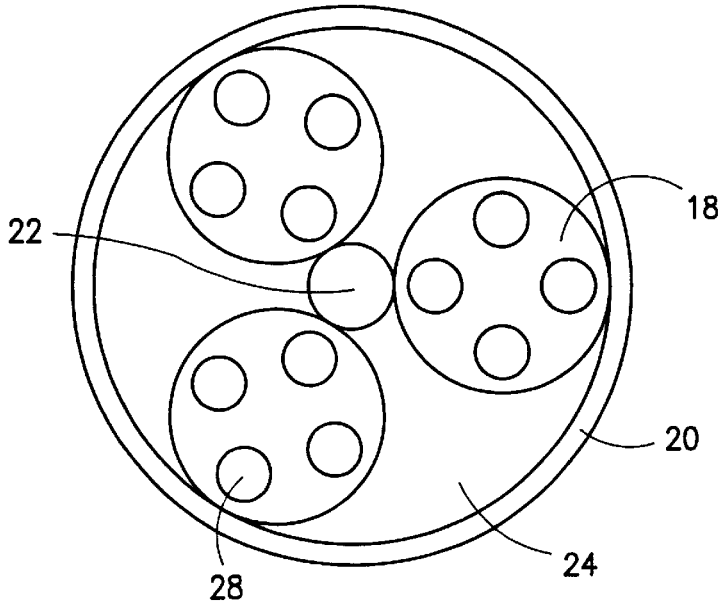
FIG. 4 is a top-down view of another exemplary aspect of the polishing machine shown in FIG. 2, with an upper platen being removed for illustration purposes.

Further, in the exemplary polishing machine 12, there may be a total of ten carriers 18 disposed between the platens 14, 16. However, only one carrier has been shown in FIG. 3 for ease of illustration. Since each of the described carriers 18 can retain five disks 10, up to fifty disks can be polished simultaneously. Of course, the number of carriers can be varied within the scope of the invention. For example, the exemplary embodiment shown in FIG. 4 is adapted to use only three carriers 18.

As best shown in FIG. 2, the typical polishing machine 12 is further provided with a so-called polishing pad 24, formed from polyurethane for example, on a surface of each platen 14, 16. The polishing pads 24 protect the surfaces of the disks 10 from being damaged from the hard surfaces of the platens 14, 16 during the polishing process, and help retain a polishing slurry in contact with the surfaces of the disks. The polishing pads 24 thus separate the surfaces of the platens 14, 16 from the surfaces of the disks 10 during the polishing operation.

To polish the disks 10, one or more disks are placed in a respective carrier 18. The polishing slurry (not shown) may then be provided on a surface of the disks 10. The platens 14, 16 are next brought close together using a press 25, for example, to exert a predetermined pressure upon the disks 10. The carriers 18 and disks 10 are then rotated, causing the slurry to planarize and polish the surfaces of the disks. Variations in the order of the steps of the polishing operation are within the scope of the invention.

Figure 5:
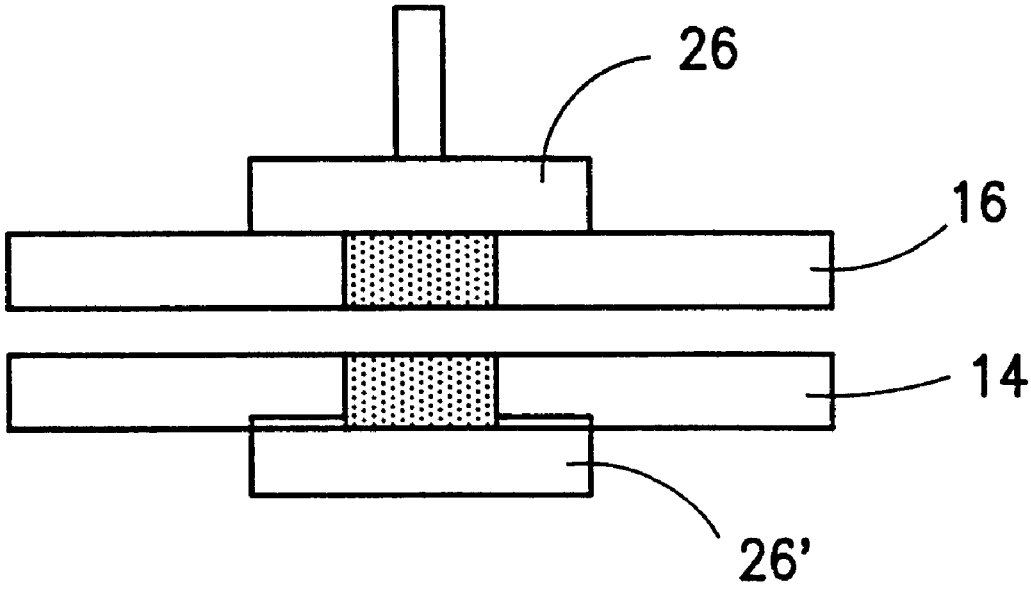
FIG. 5 PRIOR ART
FIG. 5 illustrates the platens of the polishing machine shown in FIG. 2 during a conventional lapping procedure.

Referring also to FIG. 5, in order to provide the disks 10 with a planarized, polished surface, it had been conventionally believed that the surfaces of the platens 14, 16 should be relatively flat, and parallel to each other. To accommodate the needs of the end user, the manufacturer of the polishing machine 12 will typically lap and planarize the surfaces of the platens 14, 16 using a lapping machine 26, 26' and a flat-lapping technique, prior to the polishing machine 12 being shipped to the end user. It had conventionally been believed that the lapping technique provided the platens 14, 16 with a relatively flat and planar surface suitable for most polishing operations.

For example, the manufacturer of the above-described Peter Wolters AC 320 polishing machine typically flat-laps the platens at a temperature of about 26° C., and at a force of about 280 daN (deca-Newtons). Since this force is spread out over a relatively large surface area, the pressure applied to the platens 14, 16 is relatively low.

In contrast, in an exemplary glass disk polishing operation, the glass disks 10 are polished at a temperature of about 26° C., but pressed by the platens at a force between about 450 daN and about 550 daN, for example at about 500 to 510 daN. With a 95 millimeter glass disk 10 having a 25 millimeter opening for a shaft, each glass disk has a relatively small surface area of about 0.006597 $m^2$. Even when the exemplary polishing machine 12 is fully accommodated with fifty disks, the total surface area is still only about 0.33 $m^2$. Thus, in the exemplary glass disk polishing operation, with an applied force of about 510 daN, the resulting average pressure is relatively high, for example about 15 kilopascals.

Figure 6:
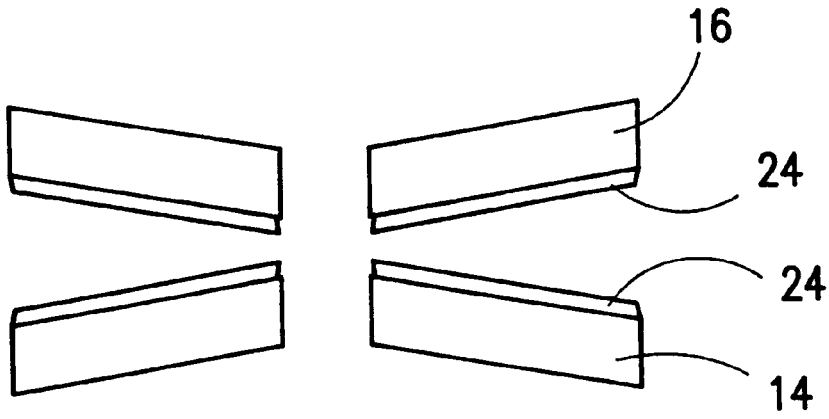
FIG. 6 illustrates the shape of the platens shown in FIG. 5, and polishing pads, during an exemplary disk polishing operation.

Referring also to FIG. 6, the present inventors have discovered that the platens 14, 16 only have a planar surface suitable for polishing glass disks 10 if the glass disk polishing operation is performed at the same or similar rotational speed, temperature and pressure that the platens were lapped at by the manufacturer. That is, at different pressures, temperatures and rotational speeds, the surfaces of the platens 14, 16 will take on different physical characteristics.

For example, it has been further noted by the present inventors that at the increased pressure used during the glass disk polishing operation, the platens 14, 16 take on a wedged profile relative to one another during the polishing operation. That is, the platens 14, 16 become distorted, so that at an inner diameter of the platens, the platens are closer together, for example by 0.005 inches, than at an outer diameter of the platens. Moreover, various other undesirable configurations of the surfaces of the platens have been observed, depending on the operating parameters of the polishing operation relative to the operating parameters used during the original lapping of the platens.

This distortion causes several problems during the polishing of the disks 10. For example, the location where the platens 14, 16 are closest together forms a pinch point, that is, an area where the carrier and/or glass disks are subject to increased pressure, i.e., greater than the exemplary 15 kilopascals. When the polishing machine 12 is operated, the carriers 18 and disks 10 will be disposed in a region of the pinch points at multiple different times during the polishing procedure. Passage through a respective pinch point will result in an increased pressure being exerted against the glass disks 10 within the carrier 18, causing increased drag on the carrier as it is rotated. Thus, the carrier 18 will be prevented from rotating as freely as would otherwise be desired. As a result, the increased pressure will tend to prematurely wear the teeth of the carrier 18. In fact, the teeth can become so worn that they shear off from the body of the carrier 18, causing the polishing machine 12 to become inoperative (i.e., a so-called mid-cycle crash). Mid-cycle crashes require that the polishing machine 12 be removed from service for an extended period of time, thus reducing thru-put and increasing the cost of operations.

Additionally, the increased pressure causes increased wear of the polishing pads 24 at their inner diameters, for example. Due to this uneven wear, the polishing pads 24 must be replaced at a relatively increased rate. Since the polishing pads 24 are typically adhered to the platens 14, 16 using an adhesive, the replacement of the polishing pads requires that the polishing machine 12 be removed from service for an extended period of time, thus reducing thru-put and increasing the cost of operations.

Moreover, the increased pressure causes the polished glass disks 10, for example, to have thickness variations from their inner diameters to their outer diameters. These thickness variations reduce the strength of the disks 10 in their thinner regions, increasing the likelihood that the disks may break and fail. Moreover, the thicker regions of the disks 10 will define how close a head of an associated disk drive can be brought to the surface of the disk. That is, when the head is over the thinner regions of the disk, the head will be further from the surface of the disk 10 than it was when it was over the thicker regions of the disk. This may lead to errors when reading and writing to the disks 10 and/or reduce the density of recording to the disk.

Thus, in a further exemplary aspect of the invention, the platens 14, 16 may be lap-polished by the end user, while operating the polishing machine 12 at the same or similar operational variables (temperature, pressure and speed) as when polishing the glass disks 10. For example, the platens 14, 16 can be lapped using a lapping disk (not shown) and a silicon-carbide compound, while exerting a force of about 500 daN (i.e., a force close to the force used in the polishing operation) over a total surface area similar to the total surface area of the glass disks to be polished. However, since the platens 14, 16 are typically formed of a hard metal, such as cast iron or stainless steel, this procedure is time consuming. For example, it may take between five and seven days to achieve the desired platen profile. During this time, the polishing machine 12 needs to be monitored closely. Thus, this procedure removes the polishing machine 12 from production for up to a week, and requires a technician to monitor and control the process.

Moreover, the silicon carbide compound is not compatible with the glass disk polishing operations. If any silicon carbide compound is transmitted to another polishing machine 12 that is in use, the silicon carbide compound could permanently taint the polishing slurry being used, requiring the slurry be replaced, and thereby further reducing through put.

Figure 7:
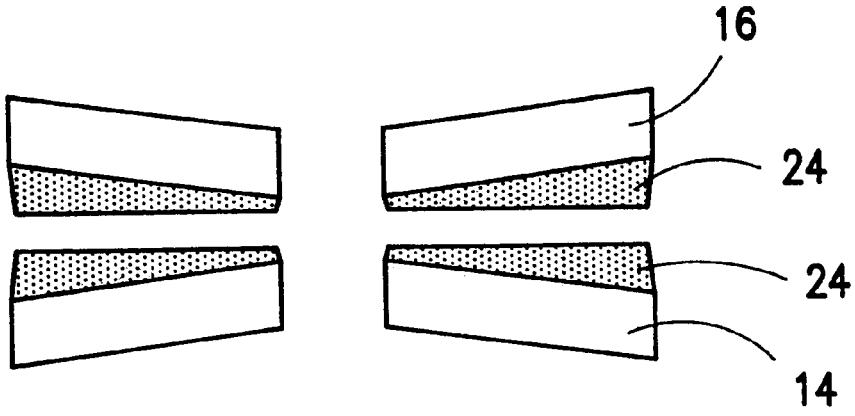
FIG. 7 illustrates the polishing pads and platens during an exemplary disk polishing operation, after dressing the polishing pads in accordance with the present invention.

Therefore, and referring to FIGS. 2, 4 and 7, in another exemplary aspect of the invention, the polishing pads 24 are dressed to compensate for irregularities in the surface profiles of the platens 14, 16. It is significantly easier to dress the polishing pads 24 to have a desired profile than it is to lap the platens 14, 16 in the manner described above. For example, whereas it may take up to a week to lap the platens 14, 16 to have a desired profile, the polishing pads 24 can be dressed in as little time as 15 to 30 minutes, for example.

In this exemplary aspect of the invention, the polishing pads 24 are dressed while operating the polishing machine 12 at the same or similar pressure, temperature and/or rotational speed as when the disks 10 are polished. By way of example, the polishing machine could be controlled during the dressing procedure to rotate the carrier 18 globally at about 1 rpm and about its axis at about 35 rpm, and to exert a pressure of about 15 kilopascals, while operating at a temperature of about 26° C. By dressing the polishing pads 24 in this manner, the underlying profile of the platens 14, 16 can be effectively ignored, since the dressed polishing pads 24 will compensate for any irregularities in the surface profile of the platens.

By way of example, and to show the effects that occur when the polishing pads are not dressed in this exemplary manner, assume that the polishing pads are dressed while operating the polishing machine 12 at a significantly different pressure, temperature and/or rotational speed as when the disks 10 are polished. For example, if the force exerted by the platens 14, 16 during the polishing of the disks 10 is about 510 daN and a pressure is about 15 kilopascals, the surfaces of the typical platens will deform. Further assume the polishing pads 24 are dressed at a force of about 160 daN, for example, and at a pressure of about 5 kilopascals until flat (i.e., at a force and pressure significantly different than those used during the disk polishing operation). The resulting polishing pads 24 would not compensate for the distortion of the platens 14, 16 when polishing the disks using a force of about 510 daN and pressure of about 15 kilopascals, since the platens would have a different surface profile at these different forces and pressures.

In another exemplary aspect of the invention, and as best shown in FIG. 4, the polishing pads 24 are dressed using specifically tailored dressing disks 28 that are disposed within the holes or recesses of the carriers 18. The dressing disks 28 have a similar configuration to the glass disks 10, so that they fit within the respective holes or recesses of the carriers in a manner similar to the glass disks 10. That is, the dressing disks 28 have a surface area similar to the disks 10. Further, and similar to the glass disks, the dressing disks 28 are thicker than the carriers 18, so that the upper and lower surfaces of the respective dressing disks contact the exposed surfaces of the polishing pads 24. This approach allows the polishing machine 12 to be operated at or near the same conditions used for polishing the glass disks 10.

With a polishing machine 12 adapted to polish fifty glass disks 10 simultaneously, fifty dressing disks 28 can be utilized to dress the polishing pads 24, allowing the same or similar force and pressure to be applied as when polishing the disks 10. However, if fewer than the fifty exemplary dressing disks 28 are used in an arrangement adapted to accommodate fifty glass disks, it may be desirable to reduce the force applied thereto. Thus, in a further exemplary aspect of the invention, the number of dressing disks can be tailored to maintain the applied pressure at a desired value. For example, if using fifty dressing disks 28, then a force of about 500 daN may be applied for the dressing operation. However, if only thirty dressing disks 28 are used, in order to maintain a similar pressure as when using fifty dressing disks, the force may be reduced to about 300 daN. This ensures that the pressure exerted by the dressing disks 28 is not so great as to destroy the polishing pads 24.

In a further aspect of the invention, the dressing disks 28 have their outer surfaces imbedded with diamond particles. Due to the hardness of the diamond particles, the dressing disks 28 are resistant to wear during the dressing procedure. The diamond particles thus ensure that the dressing disks 28 retain their dressing ability for a relatively long period of time. Moreover, the diamond particles allow the dressing procedure to be performed without requiring any further dressing compounds, which may contaminate the polishing procedures. However, water may be used during the dressing procedure to reduce heat build-up and to rinse away particles of the polishing pads 24 removed during the dressing procedure.

The dressing disks 28 may further include a stainless steel substrate, which could be plated with a further material that serves as a carrier for the diamond particles. For example, the further material could be a nickel plating. This configuration of the dressing disks 28 has been shown to be able to withstand the high forces and pressures applied during the dressing operation.

In order for the polishing pads 24 to compensate for the surface irregularities in the surface profiles of the platens 14, 16, the polishing pads 24 may have a thickness greater than an amount of deviation being compensated for. For example, if the surfaces of the platens 14, 16 deviate from a parallel state by 0.005 inches, then it may be desired to have relatively thick polishing pads 24, such as ones having a thickness of about 0.05 inches.

In the aforementioned processes, the parameters used during the lapping or dressing operations may be within about 10 percent or closer, for example, 5 percent, of the parameters used during the polishing of the glass disks 10. Moreover, it is currently believed that the applied pressure exerts the greatest influence on the surface profile of the platens, followed by the temperature.

It should be understood, however, that the invention is not necessarily limited to the specific process, arrangement, materials and components shown and described above, but may be susceptible to numerous variations within the scope of the invention. For example, although the above-described exemplary aspects of the invention are believed to be particularly well suited for polishing glass disks, it is contemplated that the concepts of the present invention can be applied in other applications. For example, the concepts of the present application can be utilized whenever it is desired to provide a polishing machine with planar, parallel surfaces during a polishing operation.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes and adaptations, and the same are intended to be comprehended within the meaning and range of equivalents of the appended claims.

What is claimed is:

1. A method of preparing a polishing machine for a polishing operation, comprising:

determining polishing machine operational variables used during a polishing operation;

operating a polishing machine at or near the determined operational variables; and prior to performing the polishing operation, planarizing at least one surface of the polishing machine while performing said operating a polishing machine at or near the determined operational variables;

wherein the polishing machine includes a platen, and a polishing pad on the platen, and wherein the surface of the polishing machine is a surface of the polishing pad, said planarizing including dressing the surface of the polishing pad while operating the polishing machine at or near the determined operational variables; and wherein the surface of the polishing pad is dressed to compensate for irregularities in a surface of the platen.

2. The method recited in claim 1, wherein the polishing machine operational variables include a force applied during the polishing operation.

3. The method recited in claim 2, wherein the force is applied by a platen of the polishing machine during the polishing operation.

4. The method recited in claim 2, wherein the force applied during the polishing operation is between about 450 daN and 550 daN.

5. The method recited in claim 2, wherein said operating includes operating the polishing machine with a force within 10% of the force applied during the polishing operation.

6. The method recited in claim 2, wherein said operating includes operating the polishing machine with a force within 5% of the force applied during the polishing operation.

7. The method recited in claim 1, wherein the polishing machine operational variables include a pressure applied during the polishing operation.

8. The method recited in claim 7, wherein said operating includes operating the polishing machine at a pressure within 5% of the pressure applied during the polishing operation.

9. The method recited in claim 7, wherein said operating includes operating the polishing machine at a pressure within 5% of the pressure applied during the polishing operation.

10. The method recited in claim 1, wherein the polishing machine operational variables include a temperature of a platen of the polishing machine during the polishing operation.

11. A method of preparing a polishing machine for a polishing operation, comprising:

determining polishing machine operational variables used during a polishing operation;

operating a polishing machine at or near the determined operational variables; and planarizing at least one surface of the polishing machine while performing said operating a polishing machine at or near the determined operational variables, wherein the surface of the polishing machine is a surface of a platen of the polishing machine, said planarizing including lapping the surface of the platen of the polishing machine while operating the polishing machine at or near the determined operational variables.

12. The method recited in claim 11, wherein said lapping the surface of the platen includes lapping the surface of the platen using a silicon carbide compound.

13. The method recited in claim 11, wherein the polishing machine operational variables include a pressure applied during the polishing operation.

14. A method of preparing a polishing machine for a polishing operation, comprising:

determining polishing machine operational variables used during a polishing operation;

operating a polishing machine at or near the determined operational variables; and planarizing at least one surface of the polishing machine while performing said operating a polishing machine at or near the determined operational variables, wherein the polishing machine includes a first and a second superposed platen, and wherein the at least one surface of the polishing machine comprises a surface of the first platen and a surface of the second platen, said planarizing including lapping the respective surfaces of the first and second platens while operating the polishing machine at or near the determined operational variables.

15. A method of preparing a polishing machine for a polishing operation, comprising:

determining polishing machine operational variables used during a polishing operation:

operating a polishing machine at or near the determined operational variables; and prior to performing the polishing operation, planarizing at least one surface of the polishing machine while performing said operating a polishing machine at or near the determined operational variables;

wherein the polishing machine includes a first and a second superposed platen, and a first polishing pad on the first platen and a second polishing pad on the second platen, and wherein the surface of the polishing machine is a surface of the first polishing pad and a surface of the second polishing pad, said planarizing including dressing the respective surfaces of the polishing pads while operating the polishing machine at or near the operational variables; and wherein the surfaces of the polishing pads are dressed to compensate for irregularities in surfaces of the platens.

16. The method recited in claim 1, wherein said dressing includes pressing at least one dressing disk against the surface of the polishing pad while operating the polishing machine at or near the determined operational variables.

17. The method recited in claim 16, wherein the polishing machine operational variables include a pressure applied during the polishing operation, and wherein the dressing disk is pressed against the surface of the polishing pad to apply a pressure, within 10% of the pressure applied during the polishing operation.

18. The method recited in claim 16, wherein the at least one dressing disk comprises a plurality of dressing disks.

19. The method recited in claim 16, wherein the polishing machine includes at least one carrier disposed on the surface of the polishing pad, the carrier being adapted to accommodate the dressing disk.

20. The method recited in claim 16, wherein the dressing disk comprises a diamond disk.

21. A method of preparing a polishing machine for a polishing operation comprising:

determining machine operational variables used during a polishing operation;

operating a polishing machine at or near the determined operational variables; and prior to performing the polishing operation, planarizing at least one surface of the polishing machine while performing said operating a polishing machine at or near the determined operational variables;

wherein the polishing machine includes a first and a second superposed platen, a first polishing pad on the first platen and a second polishing pad on the second platen, and a plurality of carriers disposed between the first and second polishing pads, each carrier being adapted to rotate relative to the polishing pads;

wherein the polishing machine operational variables include a pressure applied during the polishing operation; and wherein the surface of the polishing machine is a surface of the first polishing pad end a surface of the second polishing pad, said planarizing including dressing the respective surfaces of the polishing pads using a plurality of dressing disks carried by the carriers while rotating the carriers relative to the polishing pads and operating the polishing machine at or near the pressure applied during the polishing operation, and wherein the surfaces of the polishing pads are dressed to compensate for irregularities in surfaces of the platens.

22. The method recited in claim 15, wherein the polishing machine operational variables include a pressure applied during the polishing operation; and wherein said dressing includes placing at least one dressing disk between the polishing pads, and pressing the dressing disk between the polishing pads to apply a pressure, within 10% of the pressure applied during the polishing operation, against the surfaces of the polishing pads.

23. The method recited in claim 22, wherein the pressure applied during the polishing operation is about 15 kilopascals.

* * * * *